United States Patent [19]

Ju

[11] Patent Number: 5,046,882

[45] Date of Patent: Sep. 10, 1991

[54] TENT FRAME FOLDING DEVICE

[75] Inventor: Dong-Soo Ju, Seoul, Rep. of Korea

[73] Assignee: Bae Jin Corporation, Seoul, Rep. of Korea

[21] Appl. No.: 462,057

[22] Filed: Jan. 8, 1990

[30] Foreign Application Priority Data

Sep. 27, 1989 [KR] Rep. of Korea ..... 89-14046
Nov. 20, 1989 [KR] Rep. of Korea ..... 89-17118

[51] Int. Cl.[5] ..... F16B 7/04; E04H 15/44

[52] U.S. Cl. ..... 403/170; 403/218; 135/104; 135/106

[58] Field of Search ..... 403/218, 219, 217, 170, 403/173, 174, 178, 176, 171, 102; 135/112, 109, 106, 104, 98

[56] References Cited

U.S. PATENT DOCUMENTS

| | | | |
|---|---|---|---|
| 1,709,666 | 4/1929 | Hengstenberg | 403/217 X |
| 2,425,279 | 8/1947 | Harris | 135/112 |
| 2,953,145 | 9/1960 | Moss et al. | 135/104 X |
| 3,563,581 | 2/1971 | Sommerstein | 403/217 |
| 4,026,312 | 5/1977 | Beavers | 403/217 X |
| 4,194,851 | 3/1980 | Littlefield | 403/218 |
| 4,606,669 | 8/1986 | DeBliguy | 403/218 X |
| 4,637,180 | 1/1987 | Zeigler | 403/170 X |
| 4,838,003 | 6/1989 | Zeigler | 403/174 X |
| 4,941,499 | 7/1990 | Pelsue et al. | 135/104 |
| 4,966,178 | 10/1990 | Eichhorn | 135/106 X |

FOREIGN PATENT DOCUMENTS

| | | | |
|---|---|---|---|
| 2102466 | 2/1983 | United Kingdom | 403/170 |

*Primary Examiner*—Peter M. Cuomo
*Attorney, Agent, or Firm*—Donald C. Feix

[57] ABSTRACT

A tent frame folding device is disclosed which is constituted such that a locking cap is provided to the central fastening section in such a manner that the locking cap should be pressed down or lifted up, according as a lever is switched to the vertical or horizontal position, thereby making it possible to lock up or release the unfolded state of the tent only through the manipulation of the lever. According to the present invention, the folding and unfolding of a tent can be carried out in a simple manner, and the unfolded state of a tent can be securely maintained.

2 Claims, 4 Drawing Sheets

TENT FRAME FOLDING DEVICE

FIELD OF THE INVENTION

The present invention relates to a folding device for the frame of a dome shaped tent, and particularly to a folding device in which the locking function and the releasing function of a central fastening section are effectively carried out.

BACKGROUND OF THE INVENTION

In the known type of the conventional dome shaped tents, the frame of the tent is constituted in the form of a centrally fastening type like a usual umbrella.

FIG. 6 illustrates the constitution of the extensively used conventional central fastening section, and in this drawing, a central fastening block 20 is provided with supporting shoulders 21 and frame hinges 22 in an integral form, in such a manner that connecting arms 23 of the frame should be supported upon the supporting shoulders 21 when the tent is unfolded.

Therefore, when the tent is unfolded, all the forces are concentrated to the hinge section, and the hinge section has to withstand against all the forces, with the result that stresses are imposed on the brackets and the connecting pins. If the degrees of the stresses are excessive, there is the apprehension that the connecting pins can be broken, and the binding section can be damaged.

SUMMARY OF THE INVENTION

The present invention is intended to overcome the above described disadvantages of the conventional device.

Therefore, it is the object of the present invention to provide a tent frame folding device in which the supporting strength and the retaining strength of the central fastening section are reinforced.

In achieving the above object, the tent frame folding device according to the present invention is constituted such that a locking means is provided to the central fastening section, so that the frame connecting arms connected in the radiative form can be locked and released to a pivotal state so as for the load concentrated on the central fastening section to be alleviated, and so as for the tent to become usable in a safe manner without being folded for itself.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
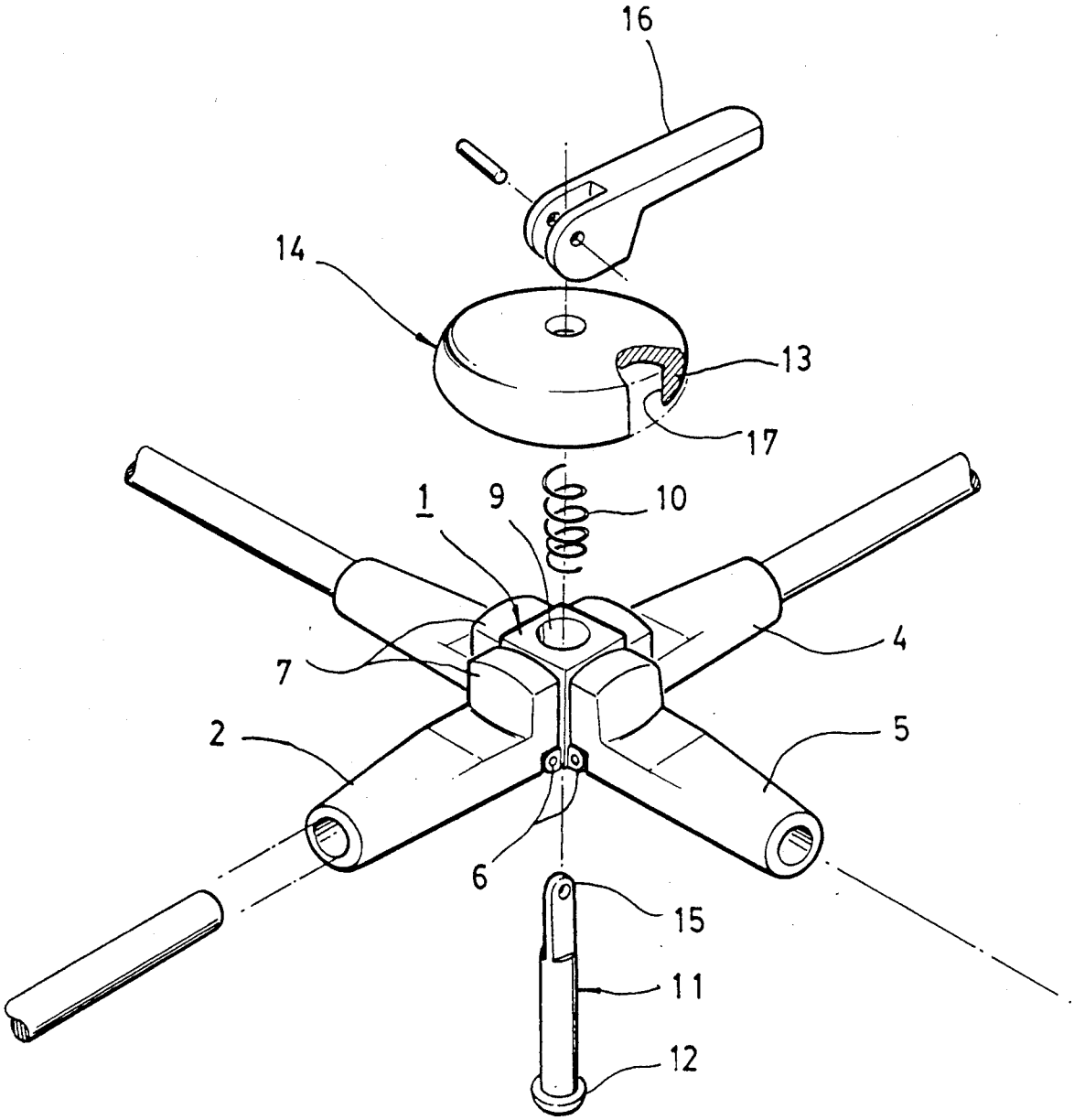
FIG. 1 is a perspective view of the whole constitution of the tent frame folding device according to the present invention.

As shown in FIG. 1, the tent frame folding device according to the present invention is constituted such that respective frame connecting arms 2,3,4,5 are connected through hinges 6 to a support 1 having a square cross section, in such a manner that the end faces of the respective frame connecting arms 2,3,4,5 should be contacted to the four side faces of the support 1. Further, the frame connecting arms are respectively provided with a vertical step 7.

The hinges 6 are disposed at the edges of the bottom of the support 1, and therefore, the vertival faces S of the support 1 are contacted with the end faces of the frame connecting arms through wide areas. Further, the support 1 is provided with a vertical hole 9 in which a narrowed portion is formed in order to provide upper and lower annular steps, and a spring 10 is inserted into the vertical hole 9 from above, while a securing pin 11 is inserted into the vertical hole 9 from below in such a manner that the upper tip 15 of the securing pin 11 should be projected above the vertical hole 9.

Further, a locking cap 14 is provided upon the support 1 so as for the upper tip 15 of the securing pin 11 to pass through the central hole of the locking cap 14, and a lever 16 is connected to the projected upper tip 15.

The locking cap 14 receives an upward force from the spring 10 on the one hand, and is also forcibly pressed down by the lever 16 on the other hand. The locking cap 14 is provided with a circular wall 13, and the inner surface 17 of the circular wall 13 forms a rectangle with the top plane of the locking cap 14, while the inside dimensions of the circular wall 13 are large enough to accommodate all the vertical steps 7 of the frame connecting arms.

The upper tip portion 15 of the securing pin is connected to an eccentric portion of the head portion of the lever 16, in such a manner that the locking cap 14 should be pressed down or lifted up, according as the lever 16 is turned to the vertical or horizontal position.

The locking cap 14 does not have to be necessarily circular, but a rectangular or any other shape may give the same effect if it is capable of accommodating all the vertical steps 7 of the frame connecting arms.

Figure 2:
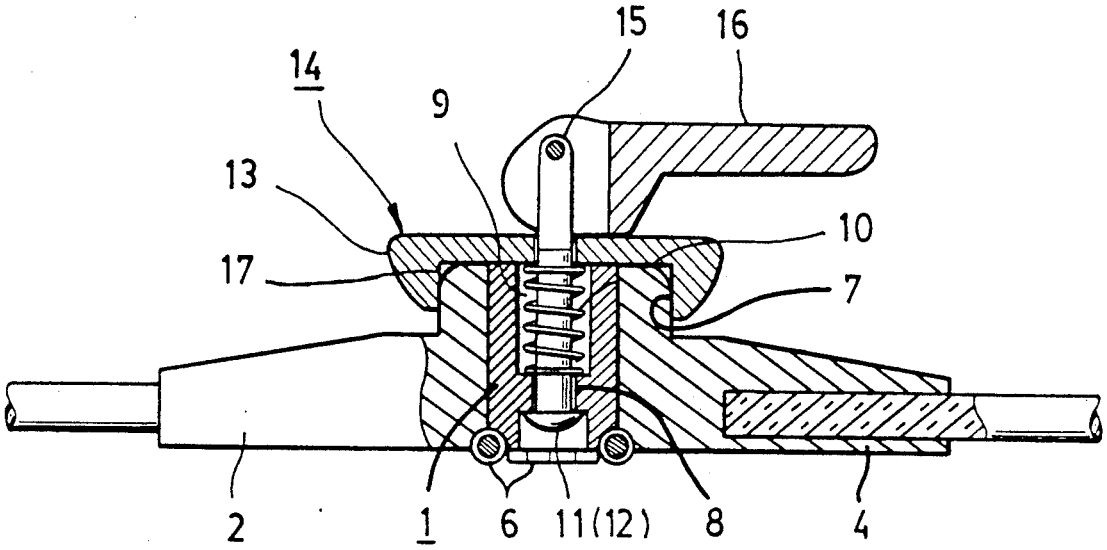
FIG. 2 is a side sectional view showing the unfolded state of the device of the present invention.
Figure 3:
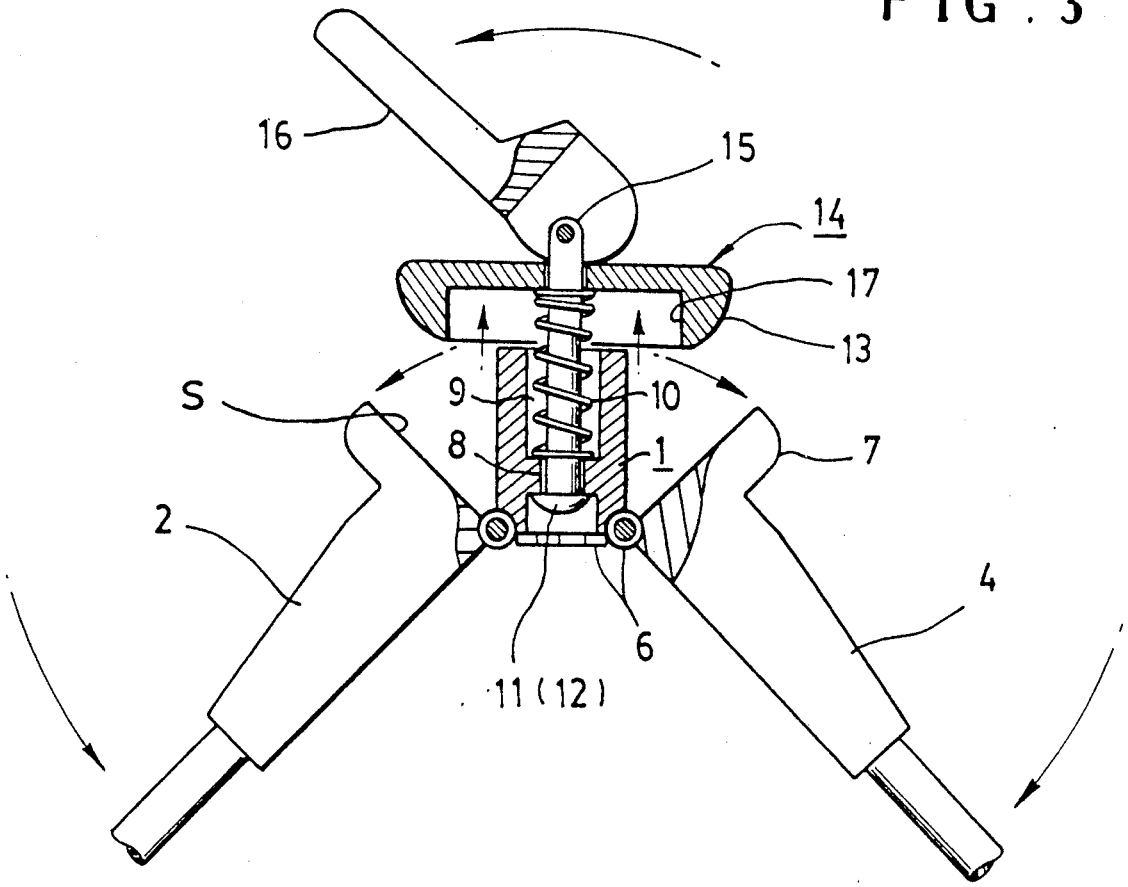
FIG. 3 illustrates the folded state of the device of the present invention.
Figure 4:
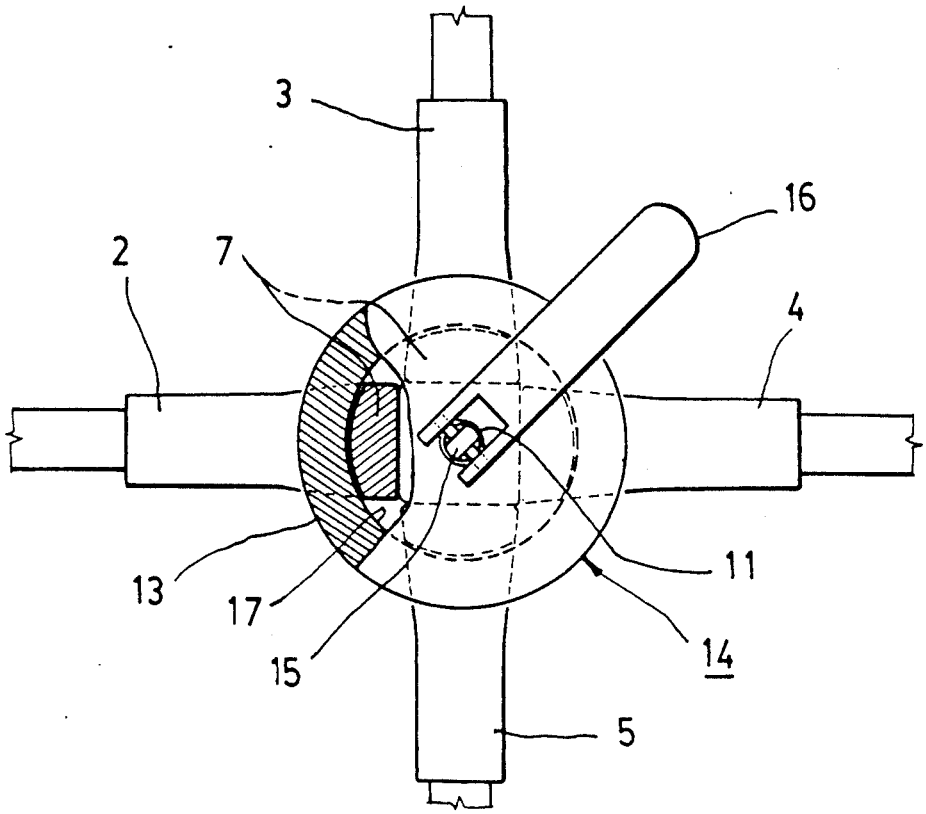
FIG. 4 is a plan view of the critical portion of the device of the present invention.
Figure 5:
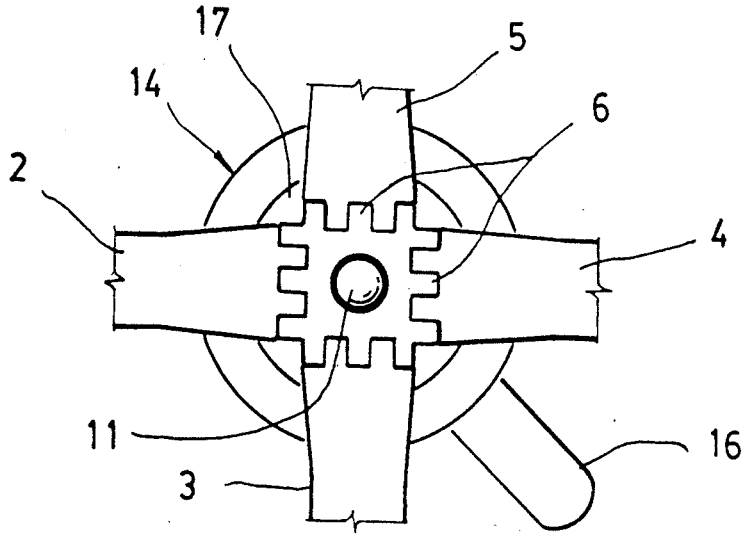
FIG. 5 is a bottom view of the device of the present invention.
Figure 6:
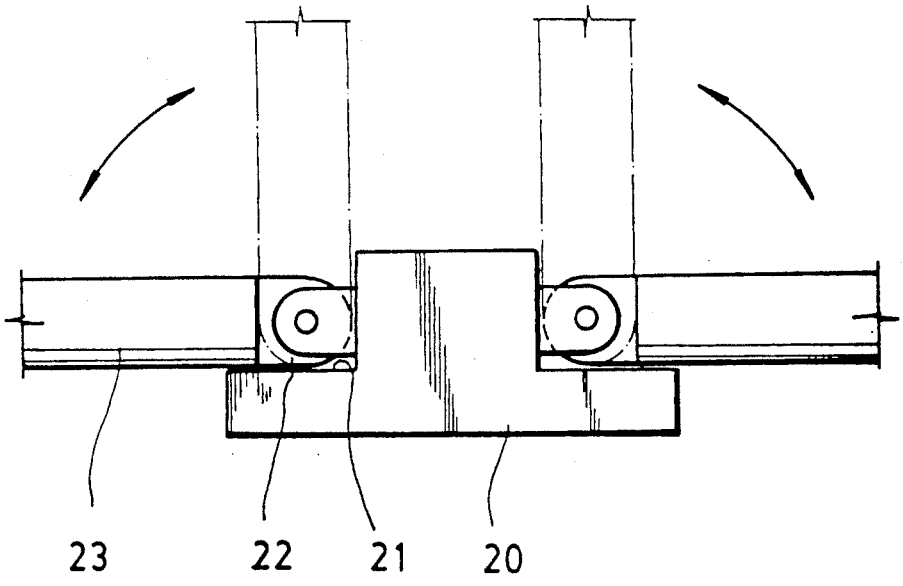
FIG. 6 is a side view of the conventional tent frame folding device.

As can be seen in FIGS. 2 and 3, the device of the present invention is operated in such a manner that, if the lever 16 is laid down to the horizontal position, then the locking cap 14 is pressed down, while, if the lever 16 is set up to the vertical position, then the locking cap 14 is lifted up by the elastic force of the spring 10.

Therefore, in the state of FIG. 3, if the frame connecting arms 2,3,4,5 are unfolded to the horizontal position, and the lever 16 is pulled down, then the vertical steps 7 of the frame connecting arms are caught into the circular wall 13 of the locking cap 14 as shown in FIG. 2, and therefore, the secured state of the vertical steps 7 can not be released as long as the lever 16 is not manipulated. Further, in this state, no significant force is applied to the hinges, thereby excluding the occurrence of a disorder.

Meanwhile, if the tent is to be folded up, first the lever 16 is lifted up so that, as shown in FIG. 3, the locking cap 14 should be elevated owing to the elastic force of the spring 10, and the vertical steps 7 should be released from the retaining of the locking cap 14. Therefore, the frame connecting arms will be downwardly pivoted supported by the hinges so as for the frame connecting arms to be folded, and then, if the other joints of the frames are folded, then the tent can be folded up into a compact shape.

Thus, according to the present invention, the folding or unfolding of the frame connecting arms can be controlled by means of only the lever 16, while, in the unfolded state, the lower ends and the upper ends of the vertical steps 7 are respectively secured by the hinges 6 and the locking cap 14 simultaneously, with the result that the unfolded state of the tent can be securely maintained without raising any apprehension.

What is claimed is:

1. A tent frame folding device for a dome shaped tent of the kind in which tent fabric supporting arms are extended radially outwardly from a central support when the tent frame is unfolded and are swung to positions in which said arms are aligned in parallel with the central support when the tent is folded, said tent frame folding device comprising, central support means for providing a central support of associated tent fabric supporting arms, said central support means having a polygonal outer periphery, as viewed in plan, and having a plurality of planar side faces each providing a wide area for supporting engagement with a vertical face of an associated tent fabric supporting arm when the tent frame is unfolded, frame connecting arm means for supporting ends of tent fabric supporting arms, said frame connecting arm means comprising an individual frame connecting arm member associated with a respective planar side face of said central support means, each frame connecting arm member having a vertical step and a vertical face on the back side of the vertical step for engagement with a respective side face of the central support means when the tent frame is unfolded, each vertical step having a front surface for engagement with a related surface of a locking cap when the tent frame is unfolded, hinge means for permitting pivoting of the frame connecting arm members on the central support means, said hinge means including a separate hinge for each frame connecting arm member and located at the lower edge of the connecting arm member so that the vertical face of the frame connecting arm member can be swung into and out of planar contact with a related planar side face of the central support means, securing pin means mounted for limited axial movement within the central support means and having an upper tip projecting above the central support means, locking cap means mounted on the upper tip of the securing pin means for axial movement into and out of a locking position with respect to the vertical steps of the frame connecting arm members, said locking cap means having an inner periphery, as viewed in bottom plan, which provides a particular inner surface for locking engagement with a front surface of a related frame connecting arm member when the locking cap means are moved into the locking position, spring biasing means for moving the locking cap means axially outwardly on the securing pin means to an unlock position in which the locking cap means are disengaged from the frame connecting arm members, locking lever means for moving the locking cap means axially inwardly on the securing pin means against the force of the spring biasing means and into said locking position, said locking lever means including a lever which is pivotally connected to the upper tip of the securing pin means and an eccentric surface which is engagable with the locking cap means for clamping the locking cap means in the locking position when the lever is moved to a locking angle and for releasing the locking cap means to the unlock position when the lever is moved to an unlock angle, and wherein the interengaged surfaces of the central support means, frame connecting arm means and locking cap means are effective to unload the hinge means in said locking position to minimize possible breakage of the hinge means and any resulting undesired folding of the tent frame.

2. The invention defined in claim 1 wherein the central support means have a square outer periphery, as viewed in plan, and wherein there are four frame connecting arm members associated with the respective four planar side faces of said central support means.

* * * * *